United States Patent [19]

Powers

[11] 4,243,177

[45] Jan. 6, 1981

[54] CHIMNEY HEAT CAPTURING SYSTEM

[76] Inventor: Edgar W. Powers, 1309 Santa Rosa Rd., Richmond, Va. 23229

[21] Appl. No.: 967,666

[22] Filed: Dec. 8, 1978

[51] Int. Cl.[3] ..... F24B 7/00

[52] U.S. Cl. ..... 237/51; 126/121; 126/122; 237/55; 165/154; 165/DIG. 2

[58] Field of Search ..... 126/121, 307 R, 120, 126/122, 132, 143; 165/154, DIG. 2; 237/55, 51

[56] References Cited

U.S. PATENT DOCUMENTS

| | | | |
|---|---|---|---|
| 1,361,389 | 12/1920 | McLeod | 126/121 |
| 1,473,422 | 11/1923 | Farquhar | 165/154 |
| 1,482,289 | 1/1924 | Dodge | 165/DIG. 2 |
| 2,274,341 | 2/1942 | Mueller | 126/121 |
| 2,767,702 | 10/1956 | Giwosky | 126/121 |
| 4,158,439 | 6/1979 | Gibbs | 165/DIG. 2 |

*Primary Examiner*—James C. Yeung
*Attorney, Agent, or Firm*—Griffin, Branigan & Butler

[57] ABSTRACT

A chimney heat capturing system comprises a chimney shell (10) having a relatively large chimney passage (20) and a flue liner (12) comprising a plurality of standardized individual liner units (28 *b, c, d,* and *e*) anchored in the chimney passage. The liner units are stacked on one another and are spaced from the chimney shell by anchor brackets (26). Each of the liner units (28 *b, c, d,* and *e*) includes outer and inner casings (30 and 32) separated by spacers for defining a heat capturing space between them. In one embodiment, each of the units is closed at its ends, and in another embodiment some of the adjacent units have open ends to communicate the heat capturing spaces of adjacent units and thereby form independent heat capturing spaces (54) defined by more than one unit. There are two ducts (40*a*–40*b,* 42*a*–42*b,* and 58–60) attached to the outer casings for each independent heat capturing space to communicate the respective heat capturing spaces with the interior of a building on which the chimney heat capturing system is constructed. Blower fans (62) move air from the building through the heat capturing spaces back into the building.

13 Claims, 7 Drawing Figures

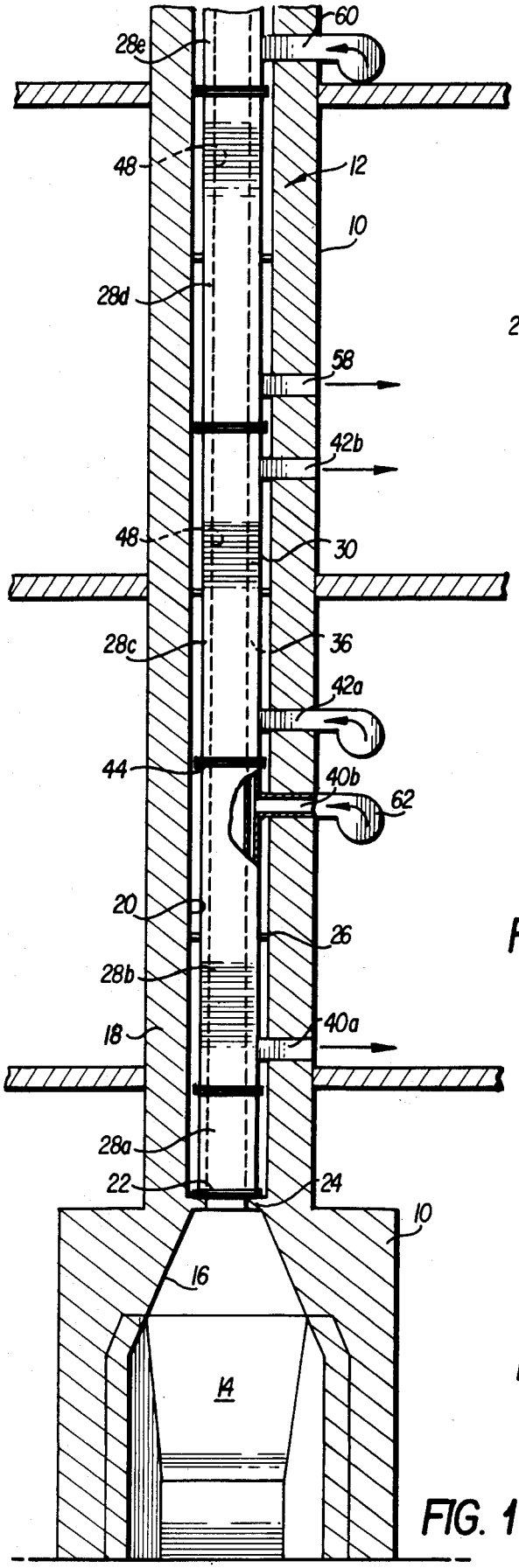
FIG. 1
FIG. 2
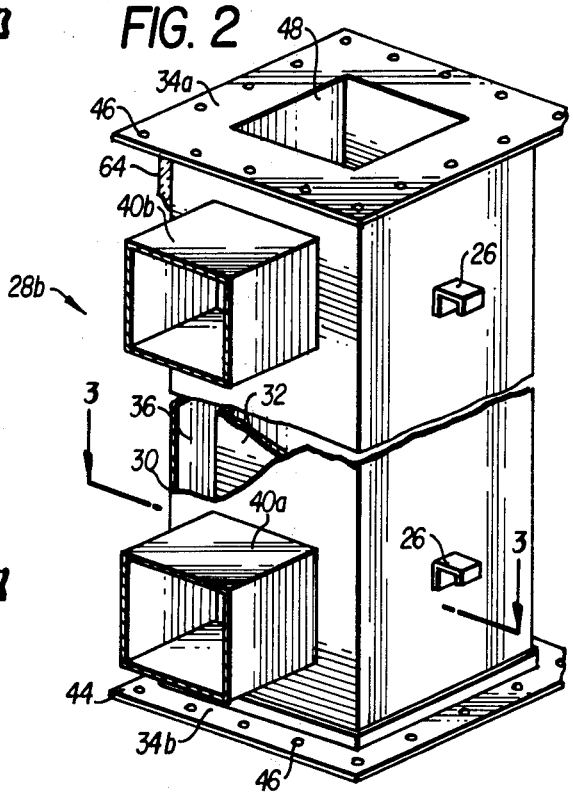
FIG. 3
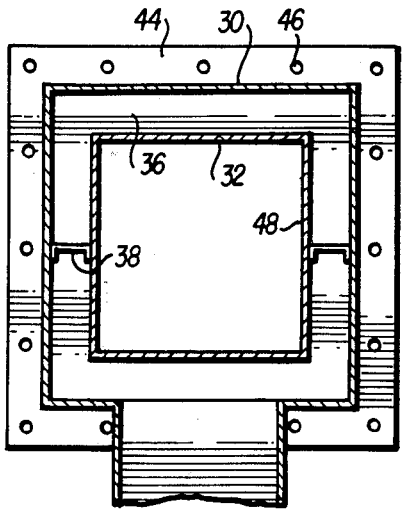
FIG. 7
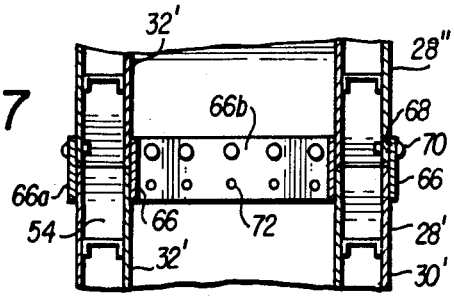

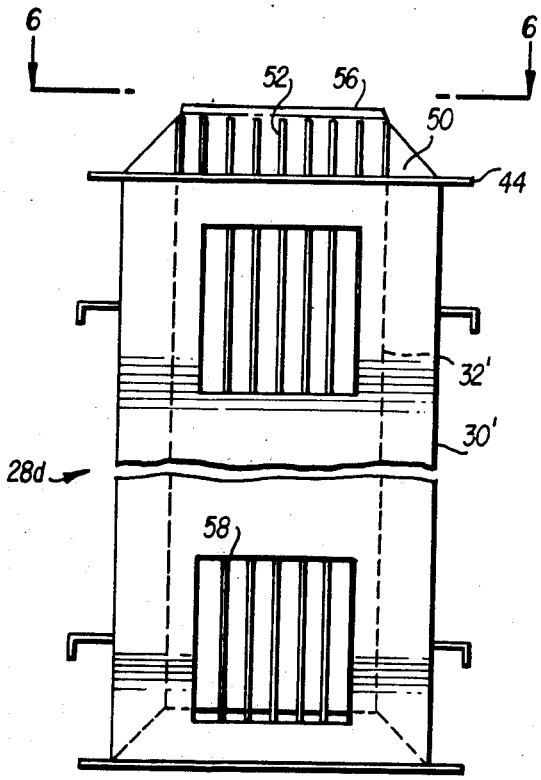
FIG. 4
FIG. 6
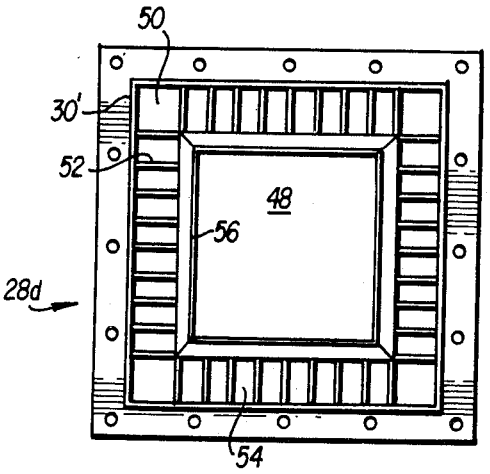
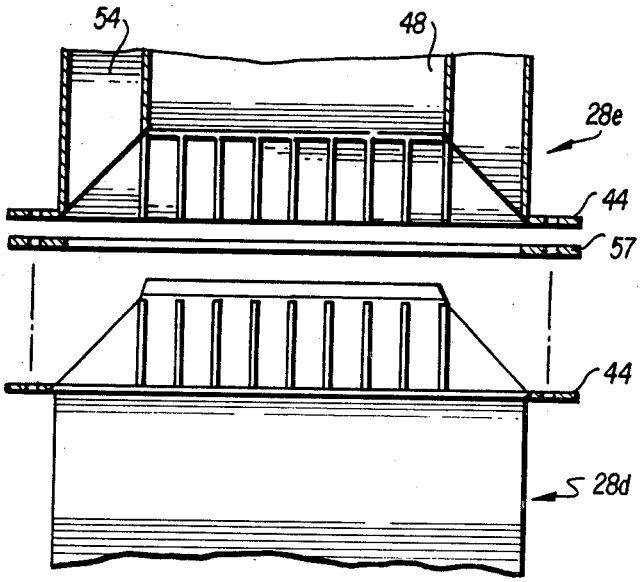
FIG. 5

CHIMNEY HEAT CAPTURING SYSTEM

BACKGROUND OF THE INVENTION

This invention relates broadly to the art of open fireplace and chimney construction and more specifically to systems for making open fireplaces and their chimneys more efficient.

Experts have long recognized the possibility of capturing heat from fireplace flues by circulating air around flue liners to pick up heat from hot air passing through the flue liners. United States patents which disclose such systems include: U.S. Pat. Nos. 289,634 to Ernst; 1,060,415 to Ayres; 1,361,389 to McLeod; 1,608,777 to Derrough; 2,093,492 to Snyder; 2,199,836 to Mairs; 2,231,258 to Elmore; 2,277,436 to Howle; 2,453,954 to Wright; 2,767,702 to Giwosky; 2,879,976 to Rose Sr.; 3,120,225 to Stark et al.; 3,547,202 to Ticknor; 3,913,663 to Gates; and, 4,010,728 to Hempel et al. However, a major difficulty with these systems is that they are not useful for general applications. That is, in most cases the various parts of the systems must be sized to fit different buildings and fireplace/chimney arrangements. Thus, in most cases, a new arrangement must be designed for each different building. Thus, it is an object of this invention to provide a chimney heat capturing system having standard elements which can be mass produced at a factory and assembled at building sites to fit almost all buildings and all fireplace and chimney arrangements.

Yet another difficulty with most of the systems disclosed in the patents cited above is that they require a great deal of coordination between bricklayers and other construction workers in that in those systems liners (such as sheet metal, or pipe liners), must be cut or formed to correspond to the shapes of laid bricks. It is therefore yet another object of this invention to provide a chimney heat capturing system which can be installed with relatively little coordination between brick masons and other construction workers.

Yet another difficulty with some of the systems described in the above mentioned patents is that they require chimney constructions which are quite different in concept from presently constructed chimneys and chimney liners and, therefore, they require unusual considerations which are difficult for brick masons, and other construction workers to adapt to. Thus, it is an object of this invention to provide a chimney heat capturing system which is constructed and installed basically in the same manner as existing chimneys and chimney liners.

Further, it is an object of this invention to provide a chimney heat capturing system which is relatively inexpensive and which is uncomplicated in structure.

It is yet another object of this invention to provide a method of constructing a heat capturing chimney which is quite similar to current methods of constructing chimneys.

SUMMARY OF THE INVENTION

According to principles of this invention, a heat capturing chimney liner is assembled and installed quite similarly as are normal chimney liners of fireplaces which are currently installed. The chimney liner is constructed of a plurality of standardized individual units which rest on each other end-to-end and which are spaced from a chimney shell by means of anchor brackets. Each of the units comprises inner and outer casings forming heat capturing spaces therebetween. Most of the units are closed at each end but in one embodiment some are open at adjacent ends to provide communication between heat capturing spaces of adjacent units. Pairs of ducts extend from interiors of buildings to the outer casings of the units to provide communication between the interiors of buildings and the heat capturing spaces. Blow fans provide circulation from the interiors of the buildings through the heat capturing spaces and back into the interiors.

BRIEF DESCRIPTION OF THE DRAWINGS

The foregoing and other objects, features and advantages of the invention will be apparent from the following more particular description of the preferred embodiments of the invention, as illustrated in the accompanying drawings in which reference characters refer to the same parts throughout the different views. The drawings are not necessarily to scale, emphasis instead being placed upon illustrating principles of the invention in a clear manner.

FIG. 1 is a partially-cross-sectional, partially-schematic, view of a fireplace and chimney of a building having a heat capturing system of this invention installed thereon;

FIG. 2 is an isometric view of a standardized individual unit forming a portion of the heat capturing system of FIG. 1;

FIG. 3 is a cross-sectional view taken on line 3—3 in FIG. 2;

FIG. 4 is a front view of a second embodiment standardized individual unit forming another portion of the heat capturing system of FIG. 1;

FIG. 5 is a sectional view of the end portion of the second embodiment standardized individual unit of FIG. 4 depicted as it is being mated with a complementary unit;

FIG. 6 is an end view of the second embodiment standardized individual unit of FIG. 4 taken on line 6—6; and FIG. 7 is a sectional view of another embodiment for coupling standardized individual units together.

DESCRIPTION OF PREFERRED EMBODIMENTS

FIG. 1 depicts a brick chimney/fireplace shell 10 having a metal heat capturing liner 12 of this invention mounted therein.

The chimney/fireplace shell 10 defines a fire chamber 14 in which a fire is made and a smoke chamber 16 which funnels smoke from a fire into the heat capturing liner. The chimney/fireplace shell 10 further defines a chimney portion 18 having a chimney passage 20 which is significantly larger than the heat capturing liner 12. The heat capturing liner 12 is supported at its lower end 22 by bricks or metal 24 which forms the upper end of the smoke chamber 16, and is supported laterally by anchor brackets 26 which are embeded between bricks forming the chimney portion 18 of the chimney/fireplace shell 10.

Describing the heat-capturing liner 12 in more detail, this liner is comprised of five individual toroidally-shaped liner units 28*a, b, c,* and *d*. Liner unit 28*a* is merely a dummy, or spacer, unit and its construction is not significant so long as it is compatible with the other units. Liner units 28*b* and *c* are identical so only liner unit 28*b* is depicted in detail in FIGS. 2 and 3. In this case, the unit comprises an outer casing 30, an inner casing 32, and top and bottom end walls 34*a* and *b*. The end walls 34*a* and *b* are attached to and space the outer and inner casings 30 and 32 three inches from one another to form a sealed heat capturing space 36 between the outer and inner casings 30 and 32. Spacer brackets 38 can be included intermediate top and bottom end walls 34*a* and 34*b* for maintaining the outer and inner casings 30 and 32 the proper distance from one another.

Each of the liner units 28*b* and *c* has a pair of ducts 40*a*, 40*b* and 42*a*, 42*b* attached to the outer casings 30 and extending through the chimney portion 18 of the chimney/fireplace shell 10 into the interior of a building on which the chimney heat capturing system is mounted. Thus, the interior of the building communicates with the heat capturing spaces 36 of liner units 28*b* and *c* via these pairs of ducts 40*a*, 40*b* and 42*a*, 42*b*.

Each of the liner units 28*b* and *c* also includes flanges 44 extending laterally about its outer periphery at the top and bottom ends thereof. The flanges 44 defines holes 46 therein through which adjacent liner units 28*a* and *b*, *b* and *c*, and *c* and *d* can be fastened together by means of sheet metal screws or bolts. Each of these liner units also includes the anchor brackets 26 attached to, and extending perpendicularly outwardly from the outer casings 30 thereof.

The outer and inner casings 30 and 32 of the second and third liner units 28*b* and *c* are constructed of 1/16" sheet metal. The flanges 44 are formed of ⅛" thick sheet metal welded to the outer and inner casings. The spacer bars 38 are also formed of ⅛" thick sheet metal.

In the depicted embodiment, liner units 28*b* and *c* are each 6 feet long, however, they could be of any length from 3 to 6 feet. Also, in the depicted embodiment the inner casings 32 form a flue passage 48 having a cross sectional size of 12" by 12", however, the size of this flue passage could vary greatly.

FIG. 4 depicts liner unit 28*d*. This unit is essentially the same as the second and third units 28*b* and *c* with the exception that the upper end 50 of the heat capturing space of liner unit 28*d* is not closed off, but rather is open and beveled, with an inner casing 32' being longer than an outer casing 30'. In this respect, numerous ⅛"×2"×3" flat bar spacers 52 are longitudinally positioned (welded) between inner and outer casings 32' and 30' close to the upper end 50 to maintain the inner and outer casings 32' and 30' spaced from one another to properly form a heat capturing space 54 between the inner and outer casings 32' and 30'. The spacers 52 are also depicted, as being beveled at their upper ends. The inner casing 32', at the upper end 50, also includes an inwardly angled protruding portion 56 to be force fitted into the flue passage 48 of the fifth liner unit 28*e* and form a seal therewith. The fourth liner unit 28*d* also includes connecting flanges 44 at its upper and lower ends to attach the liner unit 28*d* to the third and fifth liner units 28*c* and *e*. Gaskets 57 provide seals between these units.

Another difference between the fourth liner unit 28*d* and the second and third liner unit 28*b* and *c* is that the liner unit 28*d* only has one duct 58 attached to its outer casing 30 communicating with its heat capturing space 54.

The fifth liner unit 28*e* is basically the same as the fourth liner unit 28*c* with the exception that the fifth liner unit 28*e* is only 3' long, whereas the fourth liner unit 28*d* is 6' long, and the fifth liner unit 28*e* is open ended, and inversely beveled, at the bottom, rather than the top as is the fourth liner unit 28*d*. Thus, when the fourth and fifth liner units 28*d* and *e* are attached together by means of their flanges 44, as depicted in FIG. 5, they form a common heat capturing space 54 between them which is in communication with the interior of a building on which the system is mounted by means of the duct 58, which communicates with the outer casing 30' of the fourth liner unit 28*d* and a duct 60 (FIG. 1) which communicates with the heat capturing space 54 at the fifth liner unit 28*e*.

FIG. 7 depicts another arrangement for attaching the "open" liner units 28*c*, *d* and *e* together which involves spot welding ⅛ inch thick, 2 inch wide, bars 66 to outside and inside surfaces of outer and inner casings 30' and 32' of a lower unit 28' at the upper edge thereof so as to overlap the casings of the next higher unit 28''. The outside bars 66*a* have predrilled holes 68 therein to receive screws 70 for fastening the bars 66 to the outer casing 30' of the higher unit 28'', in which screw holes are made at the time of installation to avoid line-up problems. The weld at 72 must prevent smoke from getting into the heat capturing space 54 between the inner bars 66*b* and the inner casing 32'. This embodiment avoids use of a gasket. Similarly, all corners between bars 66 and of casings must be sufficiently welded to prevent smoke from getting into heat capturing spaces for this embodiment, as well as the other embodiments described herein.

In operation, the liner units 28*a*, *b*, *c*, *d*, and *e* are quite easy to install inasmuch as they are installed in a chimney/fireplace shell in the same manner as are normal flue liners which are presently used today. That is, they are supported at their lower ends by means of masonry, or metal, members 24 forming the smoke chamber 16 and they are supported laterally by anchor brackets 26. The liner units 28*a*, *b*, *c*, *d*, and *e* are stacked one on top of the other, again, in the same manner as masonry liner units which are currently used today. Thus, in operation, the liner units are constructed at a factory in various lengths, with some having open ends, and others having closed ends. In the preferred embodiment, the units are sold in 6 feet and 3 feet lengths, with some units of each length having their upper ends open, others having their lower ends open, and still others having neither end open. Thus, in the preferred embodiment there are only six types of units sold. With the six types of units, heat-capturing liners of this invention can be relatively easily installed during construction of a chimney/fireplace shell. In this respect, as a mason builds the chimney portion 18 of the chimney/fireplace shell he sequentially places the heat-capturing liner units 28*a*, *b*, *c*, *d*, and *e* one on top of the other and supports them laterally by means of the anchor brackets 26. The ducts 40*a*, *b*, and 42*a*, *b*, and 58 and 60 are attached to the various units either before or after the units are mounted one on top of the other and the mason builds his bricks around these ducts.

Once the chimney is constructed having the heat capturing liner unit of this invention, blow fans 62, such as squirrel-cage blowers, are intalled for each of the common heat capturing spaces for forcing air from the interior of the building through the heat-capturing spaces and out into the building. This forced air picks up heat in the heat-capturing spaces which was, in turn, obtained from flue gases passing through the flue passage 48.

An embellishment of this invention is to install insulation 64 on each of the liner units 28*a, b, c, d,* and *e* either at the factory, or as it is placed in position by a mason.

It will be appreciated by those skilled in the art that the chimney heat-capturing system and method described herein has universal adaptability in that it can be relatively easily constructed by mass-producing methods in a factory. In addition, it can be installed by a mason in the same manner as are existing chimney liner units. Further, it does not require a specially constructed casing, or liner for an entire chimney/fireplace shell as do many prior art heat capturing systems.

While the invention has been shown and described with reference to a preferred embodiment, it will be understood by those skilled in the art that various changes in form and detail may be made therein without departing from the spirit and scope of the invention. For example, in one embodiment of the invention, all of the units have closed ends with each one communicating with the interior of a building by means of a pair of ducts. In this respect many houses will only require one unit whose heat capturing space is closed at both ends. Other houses will employ a plurality of units, some closed, others open. Still others will employ a plurality of units, all open. In one embodiment not depicted herein the units are arranged such that fresh air is sucked from the attic and blown into several rooms. In this embodiment there can be an odd number of ducts since there is only one intake duct and a plurality of exhaust ducts.

Incidently, holes for ducts 40*a* and *b*, 42*a* and *b*, 58 and 60 can be cut into the outer casings of the units 28*a, b, c, d* and *e* by the mason upon their installation to insure that they are properly located.

The embodiments of the invention in which an exclusive property or privilege is claimed are defined as follows:

1. A chimney heat capturing system for buildings comprising:

a fireplace/chimney shell, said fireplace/chimney shell including a means for defining a fireplace at the bottom end thereof and a means for defining a smoke chamber above said fireplace, said smoke chamber having a converging shape for funneling smoke and heat from a fire at said fireplace through a hole in the top of said smoke chamber, said fireplace/chimney shell further defining a chimney-shell passage above said hole in said smoke chamber;

a flue liner formed of a plurality of similarly sized, individual, toroidally-shaped heat exchangers positioned end-to-end inside said chimney shell to form a continuous central channel above said hole for channeling all smoke and heat exiting from said hole, said individual toroidally-shaped heat exchangers each comprising an outer wall, an inner wall and spacers positioned between said outer and inner walls for maintaining a heat-capturing space between said outer and inner walls, each of said toroidally-shaped heat exchangers being constructed as a separate unit but being supported by a lower such unit, with the exception of the bottom unit which is supported by a portion of the fireplace/chimney shell defining the smoke chamber, and by spacers positioned between said outer wall and said chimney-shell passage, said outer wall being significantly smaller than said chimney-shell passage, said units including attaching means on the ends thereof for attaching them to the adjacent units;

a pair of ducts extending from the interior of said building to the outer walls of the units to be in communication with at least one heat-capturing space.

2. A chimney heat capturing system as in claim 1 wherein the heat capturing space of each of said units has closed ends.

3. A chimney heat capturing system as in claim 2 wherein said duct pair is attached to a single unit.

4. A chimney heat capturing system as in claim 3 wherein there are a plurality of duct pairs, each being attached to the heat capturing space of a separate single unit.

5. A chimney heat capturing system as in claims 1 or 4 wherein is further included a fan for each duct pair for circulating air into one of said ducts of said duct pair and out of the other duct.

6. A chimney heat capturing system as in claim 4 wherein said attaching means comprising flanges on the outer casings of said units.

7. A chimney heat capturing system as in claim 1 wherein at least two adjacent units have adjacent heat capturing space open ends and individual spacers for maintaining said heat capturing space between said inner and outer casings, said adjacent units thereby forming a common heat capturing space.

8. A chimney heat capturing system as in claim 7 wherein one duct forming a duct pair is attached to one unit forming the common heat capturing space, and the other duct is attached to the other unit forming the common heat capturing space.

9. A chimney heat capturing system as in claim 8 wherein is further included a fan for each duct pair for circulating air into one of said ducts of said duct pairs and out of the other duct.

10. A chimney heat capturing system as in claim 9 wherein said attaching means comprises flanges on the outer casings of said units.

11. A method of constructing a chimney heat capturing system comprising the steps of:

constructing individual, similarly shaped and sized, toroidally-shaped heat exchangers each comprising an outer casing, an inner casing and spacers positioned between said outer and inner casings for maintaining heat capturing spaces between said outer and inner casings;

constructing a fireplace/chimney shell with the fireplace/chimney shell defining a fireplace at the bottom thereof and a smoke chamber above the fireplace, the smoke chamber having a converging shape for funneling smoke and heat from a fire at the fireplace through a hole in the top of the smoke chamber, and with a chimney shell positioned above the hole in the smoke chamber and having an interior diameter that is larger than the hole in the smoke chamber;

positioning the individual toroidally-shaped heat exchangers end-to-end inside said chimney shell to form a flue liner above said hole for channeling smoke, this step being accomplished by supporting the lowest most individual toroidally-shaped heat exchanger on a structural member of said fireplace/chimney shell defining the smoke chamber and supporting each of the other individual toroidally-shaped heat exchangers on the adjacent lower individual toroidally-shaped heat exchanger, and by laterally supporting said individual toroidally-shaped heat exchangers by brackets extending between the chimney shell and the outer casings of the individual toroidally-shaped heat exchangers, so as to form a continuous central channel above said hole in said smoke chamber for channeling all smoke and heat exiting from said hole; and constructing pairs of ducts extending through said chimney shell and said outer casings for each of said heat capturing spaces.

12. A method of constructing a chimney heat capturing system as in claim 11 wherein each of said individual toroidally-shaped heat exchangers is constructed to have closed heat capturing space ends so that each toroidally-shaped heat exchanger forms a separate heat capturing space.

13. A method of forming a chimney heat capturing system as in claim 11 wherein some of said individual toroidally-shaped heat exchangers are constructed to have open heat capturing space ends for mating with open ends of adjacent toroidally-shaped heat exchangers to form a common heat capturing space between adjacent individual toroidally-shaped heat exchanger units.

* * * * *